US005632004A

United States Patent [19]

Bergström

[11] Patent Number: 5,632,004

[45] Date of Patent: May 20, 1997

[54] METHOD AND APPARATUS FOR ENCODING/DECODING OF BACKGROUND SOUNDS

[75] Inventor: Rolf A. Bergström, Mölndal, Sweden

[73] Assignee: Telefonaktiebolaget LM Ericsson, Stockholm, Sweden

[21] Appl. No.: 187,866

[22] Filed: Jan. 28, 1994

[30] Foreign Application Priority Data

Jan. 29, 1993 [SE] Sweden ..... 9300290

[51] Int. Cl.[6] ..... G10L 9/18

[52] U.S. Cl. ..... 395/242; 395/2.35

[58] Field of Search ..... 395/2.35, 2.42, 395/2.14, 2.23, 2.32, 2.36, 2.37; 381/29, 36; 371/65, 30, 5.5

[56] References Cited

U.S. PATENT DOCUMENTS

| | | | |
|---|---|---|---|
| 4,363,122 | 12/1982 | Black et al. | 370/81 |
| 4,700,361 | 10/1987 | Todd et al. | 395/2.35 |
| 5,007,094 | 4/1991 | Hsueh et al. | 395/2.35 |
| 5,142,582 | 8/1992 | Asakawa et al. | 381/36 |
| 5,218,619 | 6/1993 | Dent | 375/1 |
| 5,295,225 | 3/1994 | Kane et al. | 395/2.35 |
| 5,341,456 | 8/1994 | DeJaco | 395/2.23 |

FOREIGN PATENT DOCUMENTS

| | | | |
|---|---|---|---|
| 335521 | 10/1989 | European Pat. Off. | G10L 3/00 |
| 522213 | 1/1993 | European Pat. Off. | G10L 3/00 |
| 2137791 | 10/1984 | United Kingdom | G10L 1/00 |
| W089/08910 | 9/1989 | WIPO | G10L 3/00 |

OTHER PUBLICATIONS

Procedings of the IEEE 1990 National Aerospace and Electronics Conference; Folds, D. J. "Advanced audio displays in aerospace systems: technology requirements and expected benefits", p. 739–743 vol. 2 May 1990.

ICASSP–93. 1993 IEEE International Conference on Acoustics, Speech, and Signal Processing; Nishiguchi et al., "Vector Quantized MBE with simplified V/UV division at 3.0 kbits/s", pp. 151–154 vol. 2 Apr. 1993.

Vector quantized MBE with simplified V/UV division at 3.0 KBPS, Nishigushi et al., ICASSP–93. 1993 IEEE International Conference on Acoustics, Speech and Signal processing, Apr. 1993, pp. 151–154 vol. 2 Apr. 1993.

Rabiner, Schafer: "Digital Processing of Speech Signals", Chapter 8, Prentice–Hall, 1978.

Strobach: "New Forms of levinson and Schur Algorithms", IEEE SP Magazine, Jan. 1991, pp. 12–36.

Le Roux, Gueguen: "A Fixed Point Computation of Partial Correlation Coefficients", IEEE Transactions of Acoustics, Speech and Signal Processing, vol. ASSP–26, No. 3, pp. 257–259, Jun. 1977.

Atal et al, eds: "Advances in Speech Coding", Kluwer Academic Publishers, 1991, pp. 69–79.

Campbell et al.: "The DoD4.8 KBPS Standard (Proposed Federal Standard 1016)", pp. 121–134, 1991.

Salami: "Binary Pulse Excitation: A Novel Approach to Low Complexity CELP Coding of Speech", Kluwer Academic Publishers, pp. 145–156, 1991.

Adoul, Lamblin: "A Comparison of Some Algebraic Structures for CELP Coding of Speech", Proc. International Conference on Acoustics, Speech and Signal Processing 1987, pp. 1953–1956.

*Primary Examiner*—Allen R. Mac Donald
*Assistant Examiner*—Richemond Dorvil
*Attorney, Agent, or Firm*—Burns, Doane, Swecker & Mathis, L.L.P.

[57] ABSTRACT

A method and apparatus for encoding/decoding of background sounds. The background sounds are encoded/decoded in a digital frame based speech encoder/decoder. First, it is determined whether the signal that is directed to the encoder/decoder represents primarily speech or background sounds. When the signal directed to the encoder/decoder represents primarily background sounds, the temporal variation between consecutive frames and/or the domain of at least one filter defining parameter is restricted.

10 Claims, 3 Drawing Sheets

METHOD AND APPARATUS FOR ENCODING/DECODING OF BACKGROUND SOUNDS

TECHNICAL FIELD

The present invention relates to a method and an apparatus for encoding/decoding of background sounds in a digital frame based speech coder and/or decoder including a signal source connected to a filter, said filter being defined by a set of filter defining parameters for each frame, for reproducing the signal that is to be encoded and/or decoded.

BACKGROUND OF THE INVENTION

Many modern speech coders belong to a large class of speech coders known as LPC (Linear Predictive Coders). Examples of coders belonging to this class are: the 4,8 Kbit/s CELP from the U.S. Department of Defense, the RPE-LTP coder of the European digital cellular mobile telephone system GSM, the VSELP coder of the corresponding American system ADC, as well as the VSELP coder of the Pacific Digital Cellular system PDC.

These coders all utilize a source-filter concept in the signal generation process. The filter is used to model the short-time spectrum of the signal that is to be reproduced, whereas the source is assumed to handle all other signal variations.

A common feature of these source-filter models is that the signal to be reproduced is represented by parameters defining the output signal of the source and filter parameters defining the filter. The term "linear predictive" refers to a class of methods often used for estimating the filter parameters. Thus, the signal to be reproduced is partially represented by a set of filter parameters.

The method of utilizing a source-filter combination as a signal model has proven to work relatively well for speech signals. However, when the user of a mobile telephone is silent and the input signal comprises the surrounding sounds, the presently known coders have difficulties coping with this situation, since they are optimized for speech signals. A listener on the other side may easily get annoyed when familiar background sounds cannot be recognized since they have been "mistreated" by the coder.

SUMMARY OF THE INVENTION

An object of the present to provide a method and an apparatus for encoding/decoding background sounds in such a way that background sounds are encoded and reproduced accurately.

The above object is achieved by a method comprising the steps of:

(a) detecting whether the signal that is directed to said encoder/decoder represents primarily speech or background sounds; and (b) when said signal directed to said encoder/decoder represents primarily background sounds, restricting the temporal variation between consecutive frames and/or the domain of at least one filter defining parameter in said set.

The apparatus comprises:

(a) means for detecting whether the signal that is directed to said encoder/decoder represents primarily speech or background sounds; and (b) means for restricting the temporal variation between consecutive frames and/or the domain of at least one filter defining parameter in said set when said signal directed to said encoder/decoder represents primarily background sounds.

BRIEF DESCRIPTION OF THE DRAWINGS

The present invention, together with further objects and advantages thereof, may best be understood by making reference to the following description taken together with the accompanying drawings, in which.

DETAILED DESCRIPTION OF THE PREFERRED EMBODIMENTS

In a linear predictive coder the synthetic speech $\hat{S}(z)$ is produced by a source represented by its z-transform G(z), followed by a filter, represented by its z-transform H(z), resulting in the synthetic speech $\hat{S}(z)=G(z)\,H(z)$. Often the filter is modelled as an all-pole filter $H(z)=1/A(z)$, where $$A(z) = 1 + \sum_{m=1}^{M} a_m z^{-m}$$

and where M is the order of the filter.

This filter models the short-time correlation of the input speech signal. The filter parameters, $a_m$, are generally assumed to be constant during each speech frame. Typically the filter parameters are updated each 20 ms. If the sampling frequency is 8 kHz each such frame corresponds to 160 samples. These samples, possibly combined with samples from the end of the previous and the beginning of the next frame, are used for estimating the filter parameters of each frame in accordance with standardized procedures. Examples of such procedures are the Levinson-Durbin algorithm, the Burg algorithm, Cholesky decomposition (Rabiner, Schafer: "Digital Processing of Speech Signals", Chapter 8, Prentice-Hall, 1978), the Schur algorithm (Strobach: "New Forms of Levinson and Schur Algorithms", IEEE SP Magazine, January 1991, pp 12–36), the Le Roux-Gueguen algorithm (Le Roux, Gueguen: "A Fixed Point Computation of Partial Correlation Coefficients", IEEE Transactions of Acoustics, Speech and Signal Processing", Vol ASSP-26, No 3, pp 257–259, 1977). It is to be understood that a frame can consist of either more or fewer samples than mentioned above, depending on the application. In one extreme case a "frame" can even comprise only a single sample.

As mentioned above the coder is designed and optimized for handling speech signals. This has resulted in a poor coding of other sounds than speech, for instance, background sounds, music, etc. Thus, in the absence of a speech signal these coders have poor performance.

Figures 1A, 1B, 1C, 1D, 1E, 1F, 4A, 4B, 4C:
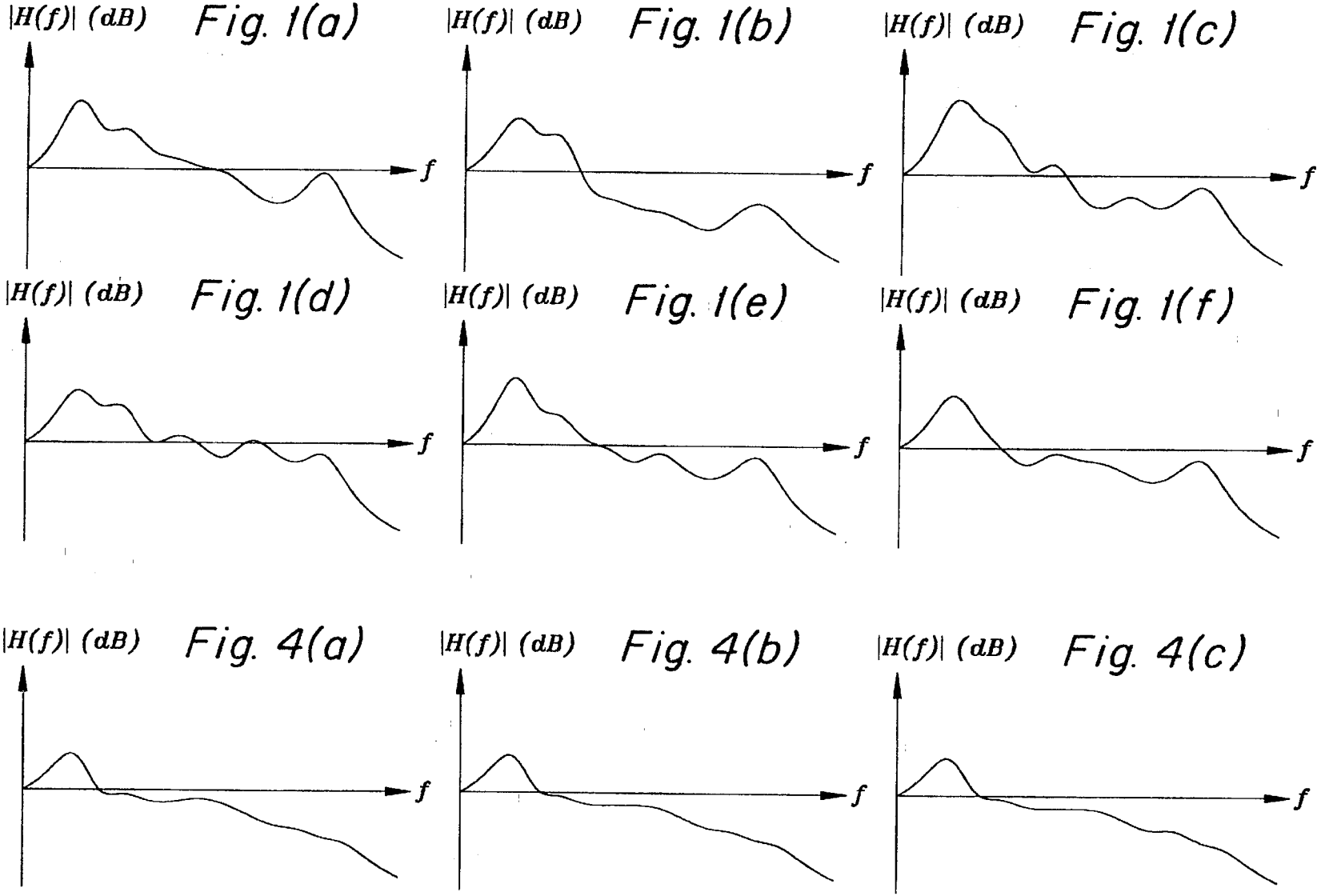
FIG. 1(*a*)–(*f*) are frequency spectrum diagrams for 6 consecutive frames of the transfer function of a filter representing background sound, which filter has been estimated by a previously known coder.
FIG. 4(*a*)–(*c*) are frequency spectrum diagrams corresponding to the diagrams of FIG. 1, but for a coder performing the method of the present invention.

FIG. 1 shows the magnitude of the transfer function of the filter (in dB) as a function of frequency ($z=e^{i2\pi f/Fs}$) for 6 consecutive frames in the case where a background sound has been encoded using conventional coding techniques. Although the background sound should be of uniform character over time (the background sound has a uniform "texture"), when estimated during "snapshots" of only 21.25 ms (including samples from the end of the previous and beginning of the next frame), the filter parameters $a_m$ will vary significantly from frame to frame, which is illustrated by the 6 frames (a)–(f) of FIG. 1. To the listener at the other end this coded sound will have a "swirling" character. Even though the overall sound has a quite uniform "texture" or statistical properties, these short "snapshots" when analyzed for filter estimation, give quite different filter parameters from frame to frame.

Figure 2:
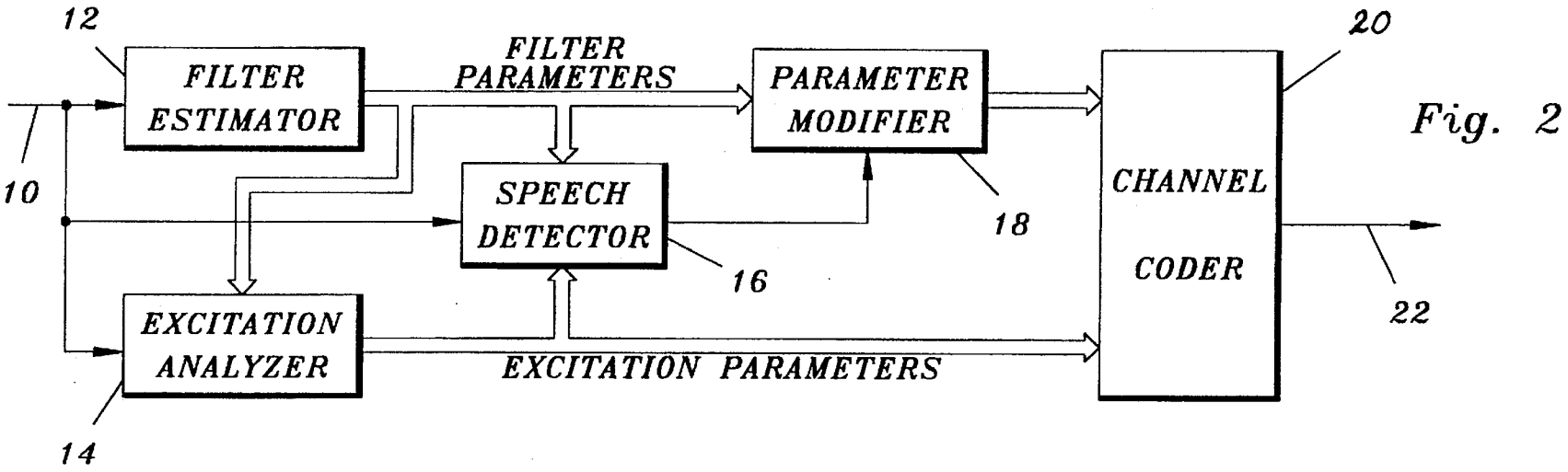
FIG. 2 is a block diagram of a speech coder for performing the method in accordance with the present invention.

FIG. 2 shows a coder in accordance with the invention which is intended to solve the above problem.

On an input line 10, an input signal is forwarded to a filter estimator 12, which estimates the filter parameters in accordance with standardized procedures as mentioned above. Filter estimator 12 outputs the filter parameters for each frame. These filter parameters are forwarded to an excitation analyzer 14, which also receives the input signal on line 10. The excitation analyzer 14 determines the best source or excitation parameters in accordance with standard procedures. Examples of such procedures are VSELP (Gerson, Jasiuk: "Vector Sum Excited Linear Prediction (VSELP)", in Atal et al, eds, "Advances in Speech Coding", Kluwer Academic Publishers, 1991, pp 69–79), TBPE (Salami, "Binary Pulse Excitation: A Novel Approach to Low Complexity CELP Coding", pp 145–156 of previous reference), Stochastic Code Book (Campbell et al: "The DoD4.8 KBPS Standard (Proposed Federal Standard 1016)", pp 121–134 of previous reference), ACELP (Adoul, Lamblin: "A Comparison of Some Algebraic Structures for CELP Coding of Speech", Proc. International Conference on Acoustics, Speech and Signal Processing 1987, pp 1953–1956) These excitation parameters, the filter parameters and the input signal on line 10 are forwarded to a speech detector 16. This detector 16 determines whether the input signal comprises primarily speech or background sounds. A possible detector, is for instance, the voice activity detector defined in the GSM system (Voice Activity Detection, GSM-recommendation 06.32, ETSI/PT 12). A suitable detector is described in EP,A,335 521 (BRITISH TELECOM PLC). The speech detector 16 produces an output signal indicating whether the coder input signal contains primarily speech or not. This output signal together with the filter parameters is forwarded to a parameter modifier 18.

The parameter modifier 18, which will be further described with reference to FIG. 5, modifies the determined filter parameters in the case where there is no speech signal present in the input signal to the coder. If a speech signal is present the filter parameters pass through the parameter modifier 18 without change. The possibly changed filter parameters and the excitation parameters are forwarded to a channel coder 20, which produces the bit-stream that is sent over the a line 22.

The parameter modification by the parameter modifier 18 can be performed in several ways.

One possible modification is a bandwidth expansion of the filter. This means that the poles of the filter are moved towards the origin of the complex plane. Assuming that the original filter $H(z)=1/A(z)$ is given by the expression mentioned above, when the poles are moved with a factor r, $0 \leqq r \leqq 1$, the bandwidth expanded version is defined by $A(z/r)$, or:

$$A\left(\frac{z}{r}\right)=1+\sum_{m=1}^{M}(a_m r^m)z^{-m}$$

Another possible modification is low-pass filtering of the filter parameters in the temporal domain. That is, rapid variations of the filter parameters from frame to frame are attenuated by low-pass filtering at least some of said parameters. A special case of this method is averaging of the filter parameters over several frames, for instance, 4–5 frames.

The parameter modifier 18 can also use a combination of these two methods, for instance, perform a bandwidth expansion followed by low-pass filtering. It is also possible to start with low-pass filtering and then add the bandwidth expansion.

In the embodiment illustrated in FIG. 2 the speech detector 16 is positioned after a filter estimator 12 and a excitation analyzer 14. Thus, in this embodiment the filter parameters are first estimated and then modified in the absence of a speech signal. Another possibility would be to detect the presence/absence of a speech signal directly, for instance by using two microphones, one for speech and one for background sounds. In such an embodiment, it would be possible to modify the filter estimation itself in order to obtain proper filter parameters also in the absence of a speech signal.

In the above explanation of the present invention, it has been assumed that the parameter modification is performed in the coder in the transmitter. However, it is appreciated that a similar procedure can also be performed in the decoder of the receiver. This is illustrated by the embodiment illustrated in FIG. 3.

Figure 3:
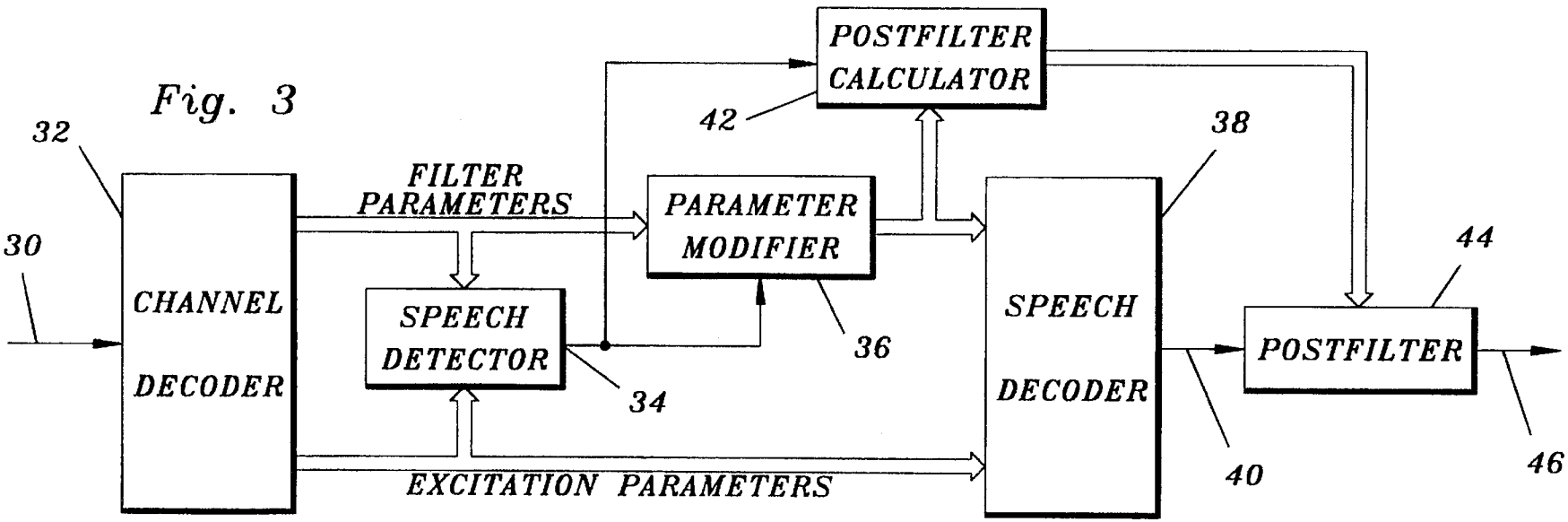
FIG. 3 is a block diagram of a speech decoder for performing the method in accordance with the present invention.

In FIG. 3, a bit-stream from the channel is received on an input line 30. This bit-stream is decoded by a channel decoder 32. The channel decoder 32 outputs filter parameters and excitation parameters. In this case, it is assumed that these parameters have not been modified in the coder of the transmitter. The filter and excitation parameters are forwarded to a speech detector 34, which analyzes these parameters to determine whether the signal that would be reproduced by these parameters contains a speech signal or not. The output signal of the speech detector 34 is forwarded to a parameter modifier 36, which also receives the filter parameters. If the speech detector 34 has determined that there is no speech signal the present in the received signal, parameter modifier 36 performs a modification similar to the modification performed by the parameter modifier 18 of FIG. 2. If a speech signal is present no modification occurs. The possibly modified filter parameters and the excitation parameters are forwarded to a speech decoder 38, which produces a synthetic output signal on a line 40. The speech decoder 38 uses the excitation parameters to generate the above mentioned source signals and the possibly modified filter parameters to define the filter in the source-filter model.

As mentioned above, the parameter modifier 36 modifies the filter parameters in a similar way as parameter modifier 18 in FIG. 2. Thus, possible modifications are a bandwidth expansion, low-pass filtering or a combination of the two.

In a preferred embodiment, the decoder of FIG. 2 also contains a postfilter calculator 42 and an postfilter 44. A postfilter in a speech decoder is used to emphasize or de-emphasize certain parts of the spectrum of the produced speech signal. If the received signal is dominated by background sounds an improved signal can be obtained by tilting the spectrum of the output signal on line 40 in order to reduce the amplitude of the higher frequencies. Thus, in the embodiment of FIG. 3, the output signal of the speech detector 34 and the output filter parameters of the parameter modifier 36 are forwarded to the postfilter 42. In the absence of a speech signal in the received signal postfilter, a calculator 42 calculates a suitable tilt of the spectrum of the output signal on the line 40 and adjusts the postfilter 44 accordingly. The final output signal is obtained on a line 46.

From the above description it is clear that the filter parameter modification can be performed either in the encoder of the transmitter or in the decoder of the receiver. This feature can be used to implement the parameter modification in the encoder and decoder of a base station. In this way it would be possible to take advantage of the improved coding performance for background sounds obtained by the present invention without modifying the encoders/decoders of the mobile stations. When a signal containing background noise is obtained by the base station over the land system, the parameters are modified at the base station so that already modified parameters will be received by the mobile station, where no further actions need to be taken. On the other hand, when the mobile station sends a signal containing primarily background noise to the base station, the filter parameters characterizing this signal can be modified in the decoder of the base station for further delivery to the land system.

Another possibility would be to divide the filter parameter modification between the coder at the transmitter end and the decoder at the receiver end. For instance, the poles of the filter could be partially moved closer to the origin of the complex plane in the coder and be moved closer to the origin in the decoder. In this embodiment, a partial improvement of performance would be obtained in mobiles without parameter modification equipment and the full improvement would be obtained in mobiles with this equipment.

To illustrate the improvements that are obtained by the present invention, FIG. 4 shows the spectrum of the transfer function of the filter in three consecutive frames containing primarily background sound. FIGS. 4(*a*)–(*c*) have been produced with the same input signal as FIGS. 1(*a*)–(*c*). However, in FIG. 4, the filter parameters have been modified in accordance with the present invention. It is appreciated that the spectrum varies very little from frame to frame in FIG. 4.

Figure 5:
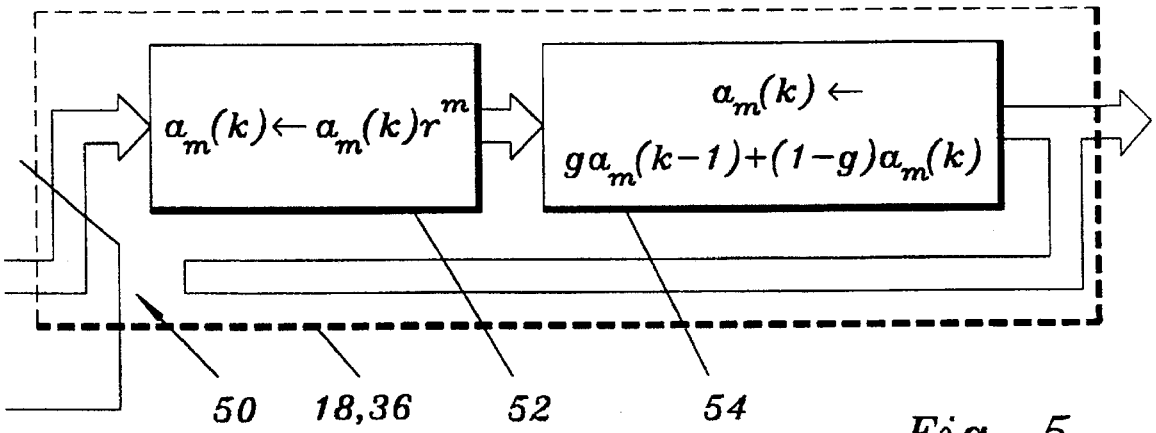
FIG. 5 is a block diagram of the parameter modifier of FIG. 2.

FIG. 5 shows a schematic diagram of a preferred embodiment of the parameter modifier 18, 36 used in the present invention. A switch 50 directs the unmodified filter parameters either directly to the output or to blocks 52, 54 for parameter modification, depending on the control signal from the speech detector 16, 34. If the speech detector 16, 34 has detected primarily speech, the switch 50 directs the parameters directly to the output of the parameter modifier 18, 36. If the speech detector 16, 34 has detected primarily background sounds, the switch 50 directs the filter parameters to an assignment block 52.

The assignment block 52 performs a bandwidth expansion on the filter parameters by multiplying each filter coefficient $a_m(k)$ by a factor $r^m$, where $0 \leqq r \leqq 1$ and k refers to the current frame, and assigning these new values to each $a_m(k)$. Preferably, r lies in the interval 0.85–0.96. A suitable value is 0.89.

The new values $a_m(k)$ from the block 52 are directed to assignment block 54, where the coefficients $a_m(k)$ are low pass filtered in accordance with the formula $ga_m(k-1)+(1-g)a_m(k)$, where $0 \leqq g \leqq 1$ and $a_m(k-1)$ refers to the filter coefficients of the previous frame. Preferably, g lies in the interval 0.92–0.995. A suitable value is 0.995. These modified parameters are then directed to the output of the parameter modifier 18, 36.

In the described embodiment, the bandwidth expansion and low pass filtering was performed in two seperate blocks. It is, however, also possible to combine these two steps into a single step in accordance with the formula $a_m(k) \leftarrow ga_m(k-1)+(1-g)a_m(k)r^m$. Further more, the low pass filtering step involved only the present and one previous frames. However, it is also possible to include older frames, for instance, 2–4 previous frames. The low pass filter may also include zeroes or comprise an FIR filter.

Figure 6:
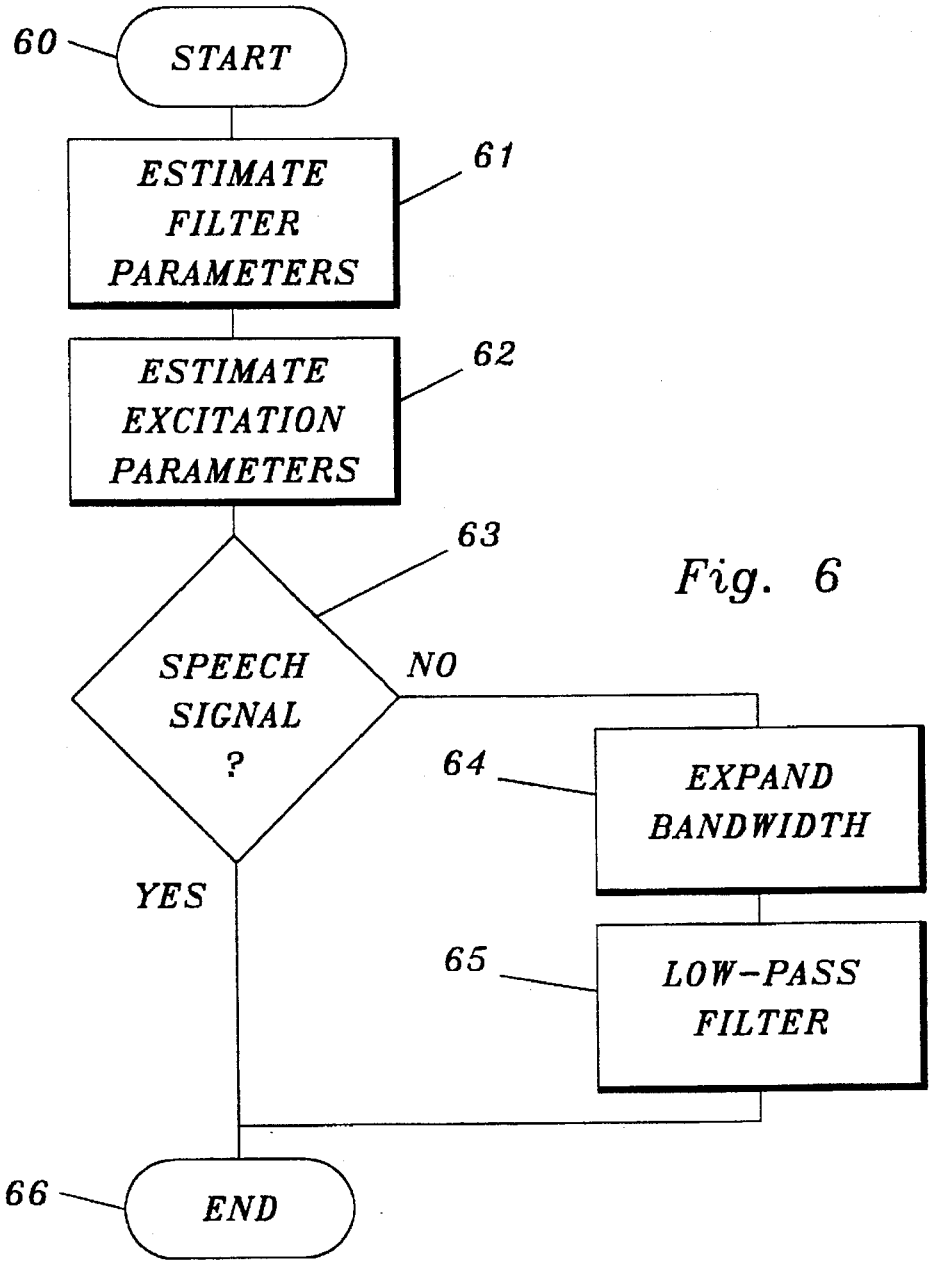
FIG. 6 is a flow chart illustrating the method of the present invention.

FIG. 6 shows a flow chart illustrating a preferred embodiment of the method in accordance with the present invention. The procedure starts in step 60. In step 61, the filter parameters are estimated in accordance with one of the methods mentioned above. These filter parameters are then used to estimate the excitation parameters in step 62. This is done in accordance with one of the methods mentioned above. In step 63, the filter parameters and excitation parameters and possibly the input signal itself are used to determine whether the input signal is a speech signal or not. If the input signal is a speech signal, the procedure proceeds to final step 66 without modification of the filter parameters. If the input signal is not a speech signal, the procedure proceeds to step 64, in which the bandwidth of the filter is expanded by moving the poles of the filter closer to the origin of the complex plane. Thereafter, the filter parameters are low-pass filtered in step 65, for instance, by forming the average of the current filter parameters from step 64 and filter parameters from previous signal frames. Finally the procedure proceeds to final step 66.

In the above description, the filter coefficients $a_m$ were used to illustrate the method of the present invention. However, it is to be understood that the same basic ideas can be applied to other parameters that define or are related to the filter, for instance, filter reflection coefficients, log area ratios (lar), roots of polynomial, autocorrelation functions (Rabiner, Schafer: "Digital Processing of Speech Signals", Prentice-Hall, 1978), arcsine of reflection coefficients (Gray, Markel: "Quantization and Bit Allocation in Speech Processing", IEEE Transactions on Acoustics, Speech and Signal Processing", Vol ASSP-24, No 6, 1976), and line spectrum pairs (Soong, Juang: Line Spectrum Pair (LSP) and Speech Data compression", Proc. IEEE Int. Conf. Acoustics, Speech and Signal Processing 1984, pp 1.10.1–1.10.4).

Furthermore, another modification of the described embodiment of the present invention would be an embodiment where there is no post filter in the receiver. Instead, the corresponding tilt of the spectrum is obtained already in the modification of the filter parameters, either in the transmitter or in the receiver. This can, for instance, be done by varying the so called reflection coefficient 1.

It will be understood by those skilled in the art that various modifications and changes may be made to the present invention without departure from the spirit and scope thereof, which is defined by the appended claims.

I claim:

1. A method of encoding and/or decoding background sounds in a digital frame based speech encoder and/or decoder including a signal source connected to a filter, said filter being defined by a set of parameters for each frame, for reproducing the signal that is to be encoded and/or decoded, said method comprising the steps of:

determining estimated filter parameters;

detecting whether the signal that is directed to said encoder/decoder represents primarily speech or background sounds; and modifying when said signal directed to said encoder/decoder represents primarily background sounds, at least one estimated filter parameter by restricting the temporal variation between consecutive frames and/or the domain of said at least one estimated filter parameter.

2. The method according to claim 1, wherein the temporal variation of said estimated filter defining parameters is restricted by low pass filtering said estimated filter parameters over several frames.

3. The method according to claim 2, wherein the temporal variation of the estimated filter parameters is restricted by averaging said estimated filter parameters over several frames.

4. The method according to claim 1, wherein the domain of said estimated filter parameters is modified to move the poles of the filter closer to the origin of the complex plane.

5. The method according to claim 1, wherein the signal obtained by said source and said filter with modified parameters is further modified by a postfilter to emphasize or de-emphasize predetermined frequency regions therein.

6. An apparatus for encoding and/or decoding background sounds in a digital frame based speech encoder and/or decoder including a signal source connected to a filter, said filter being defined by a set of parameters for each frame, for reproducing the signal that is to be encoded and/or decoded, said apparatus comprising:

means for determining estimated filter parameters;

means for detecting whether the signal that is directed to said encoder/decoder represents primarily speech or background sounds; and means for modifying at least one estimated filter parameter by restricting the temporal variation between consecutive frames and/or the domain of said at least one estimated filter parameter when said signal directed to said encoder/decoder represents primarily background sounds.

7. The apparatus according to claim 6, wherein the temporal variation of said estimated filter parameters is restricted by a low pass filter that filters said estimated filter parameters over several frames.

8. The apparatus according to claim 7, wherein the temporal variation of the estimated filter parameters is restricted by a low pass filter that averages said estimated filter parameters over several frames.

9. The apparatus according to claim 6, wherein the domain of said estimated filter parameters is modified in means that move the poles of the filter closer to the origin of the complex plane.

10. The apparatus according to claim 6, wherein the signal obtained by said source and said filter with modified parameters is further modified by a postfilter to emphasize or de-emphasize predetermined frequency regions therein.

* * * * *